US010751589B2

(12) United States Patent
Brown

(10) Patent No.: US 10,751,589 B2
(45) Date of Patent: Aug. 25, 2020

(54) LACROSSE HEAD

(71) Applicant: Austin Brown, Glen Rock, PA (US)

(72) Inventor: Austin Brown, Glen Rock, PA (US)

(73) Assignee: WM. T. BURNETT IP, LLC, Baltimore, MD (US)

( * ) Notice: Subject to any disclaimer, the term of this patent is extended or adjusted under 35 U.S.C. 154(b) by 163 days.

(21) Appl. No.: 15/430,576

(22) Filed: Feb. 13, 2017

(65) Prior Publication Data

US 2017/0232315 A1 Aug. 17, 2017

Related U.S. Application Data

(60) Provisional application No. 62/294,016, filed on Feb. 11, 2016.

(51) Int. Cl.
*A63B 59/20* (2015.01)
*A63B 60/52* (2015.01)
*A63B 102/14* (2015.01)

(52) U.S. Cl.
CPC ..... *A63B 59/20* (2015.10); *A63B 60/52* (2015.10); *A63B 2102/14* (2015.10)

(58) Field of Classification Search
CPC ..... A63B 59/20; A63B 2102/14
See application file for complete search history.

(56) References Cited

U.S. PATENT DOCUMENTS 5,494,297 A * 2/1996 MacNeil ..... A63B 59/20 473/513
5,568,925 A * 10/1996 Morrow ..... A63B 59/20 473/513
2004/0058758 A1* 3/2004 Kohler ..... A63B 49/035 473/513
2005/0197216 A1* 9/2005 Kohler ..... A63B 59/20 473/513
2005/0221923 A1* 10/2005 Gait ..... A63B 59/20 473/513
2006/0194655 A1* 8/2006 Tucker, Sr. ..... A63B 59/20 473/513
2006/0205542 A1* 9/2006 Tucker, Jr. ..... A63B 59/20 473/513
2007/0060423 A1* 3/2007 Morrow ..... A63B 59/20 473/513
2008/0020871 A1* 1/2008 Morrow ..... A63B 59/20 473/513

(Continued)

*Primary Examiner* — Melba Bumgarner
*Assistant Examiner* — Amir A Klayman
(74) *Attorney, Agent, or Firm* — Royal W. Craig; Gordon Feinblatt LLC

(57) ABSTRACT

A lacrosse head having a front scoop geometry optimized to promote smooth ground ball play such as scooping of a ball by ground contact. The lacrosse head has a distal scoop with a mid-section cross-section shaped like a chef's-knife with a foremost point, a rear edge (lower edge of tang), a rearmost corner point (tower distal end of tang), a low continuous curve point (where heel joins choil), and rear-innermost point (choil), with a continuous perimeter bounding all of said points, the perimeter bounding said rear edge, lowest continuous curve point, and rear-innermost point defining a cavity extending toward said foremost point. The perimeter joining the foremost point and low continuous curve point is formed to optimize ground ball play when incorporated into a lacrosse head scoop,

24 Claims, 3 Drawing Sheets

(56) References Cited

U.S. PATENT DOCUMENTS

| | | | | |
|---|---|---|---|---|
| 2008/0026884 | A1* | 1/2008 | Morrow | A63B 59/20 473/513 |
| 2008/0293524 | A1* | 11/2008 | Gait | A63B 59/20 473/513 |
| 2011/0136599 | A1* | 6/2011 | Hayden | A63B 59/20 473/513 |
| 2018/0207498 | A1* | 7/2018 | Larson | A63B 59/20 |

* cited by examiner

LACROSSE HEAD

CROSS-REFERENCE TO RELATED APPLICATIONS

The present application derives priority from U.S. Provisional Patent Application No. 62/294,016 filed 11 Feb. 2016.

BACKGROUND OF THE INVENTION

1. Field of the Invention

The present invention relates to lacrosse and, more particularly, to an improved head for a lacrosse stick adapted for improved playing characteristics.

2. Description of the Background

In 1970, the introduction of double-wall, synthetic lacrosse heads revolutionized the game of lacrosse. In comparison to the traditional single-wall heads made of wood, the molded synthetic heads imparted a lightness, maneuverability, and flexibility never-before experienced by lacrosse players. These performance advantages greatly enhanced players' skills such as throwing, catching, cradling, and scooping, and brought the sport of lacrosse to new levels of speed and excitement.

FIG. 1 illustrates a typical molded double-wall synthetic head 104 mounted on a handle 100 (dotted lines). Head 104 comprises a generally V-shaped frame having a juncture 106, sidewalls 108 and 110, a transverse wall for ("scoop") 112 joining the sidewalls at their ends opposite juncture 106, and a stop member 114 joining sidewalls 108 and 110 at their ends nearest juncture 106. As shown, handle 2 fits into and through juncture 106, and abuts stop member 114. A screw or other fastener placed through opening 107 secures handle 102 to head 104. Sidewalls 108 and 110 have an inside face, an outside face, a bottom rail edge from which the pocket (not shown) is traditionally strung, and a top rail edge opposite the bottom rail edge. This geometry allows a ball to freely roll within the pocket along a sidewall or stop member without obstruction, from the back of the pocket to the front face of head 104.

Viewed from the exterior side (FIG. 3), the scoop 112 of the double-wall synthetic head 104 includes a peripheral side rail 127 and a base 129, as seen in FIG. 2. However, as seen in FIG. 3 the side rail 127 and base 129 are not necessarily a uniform monolithic block. To conserve weight and/or material they may be a rather complex molded framework of reinforcing, layered walls. Moreover, the shape often changes from the center of scoop 112 toward the peripheral side rails 127. For example, the cross-sectional profile of scoop 112 may change from position A- A' to position B-B' (FIG. 2), in this instance morphing from the centrally split ribbed cross-section shown in dotted lines in FIG. 3 (A-A' of FIG. 2) to an airfoil shape outward along side rail 127 (toward B-B' of FIG. 2).

FIG. 4 isolates one prior art cross-section of scoop 112 at its foremost center-point A-A'. FIG. 5 isolates the prior art cross-section of scoop 112 at peripheral center-point B-B', which cross-section resembles a knife blade (inset at right). In both cases of FIGS. 4-5. the respective cross-sections can be characterized by a foremost point FP, a rear edge RE, a rearmost corner point (RCP), a low continuous curve—point LCP, and rear-innermost point RI. String holes intermittently penetrate the scoop 112 between the rear edge RE and low continuous curve point LCP for stringing the pocket, and the strung pocket results in looped strings S a shown in FIG. 5. If the lacrosse head of FIG. 4 is placed along the x-axis of an xyz coordinate system, one observes that at its foremost center-point A-A' the perimeter between the foremost point FP and low continuous curve point LCP has a pronounced angular or jagged shape. This geometry is used primarily to achieve durability at a highly stressed portion of a lacrosse head, while also facilitating conventional clam shell mold manufacturing.+ However, it results in an inefficient and somewhat obstructive design for an essential lacrosse head maneuver, i.e., scooping. Scooping a lacrosse ball resembles a snow shoveling motion where the front and bottom side of the scoop 112 scrape the playing surface in an effort to entrap a ball that is resting or rolling on the playing surface. The jagged or angled geometry (FIG. 4) of the prior art scoop cross-sections makes for a less than smooth head/surface interaction, decreasing scooping efficiency. In addition, the conventional scoop cross-section is not configured to prevent exposed strings, leading to wear and tear of the exposed pocket strings S as seen in (FIG. 5). The strings S and playing surface (dotted lines) interact directly during play as seen in FIG. 5, resulting in substantial abrasion and wear. What is needed then is a more advanced central scoop cross-section that facilitates these two scoop shortcomings without compromising scoop durability.

SUMMARY OF THE INVENTION

It is, therefore, an object of the present invention to provide a lacrosse stick head having a front scoop geometry optimized to promote smooth ground ball play such as scooping of a ball off of a playing surface.

It is also an object of the present invention to provide a lacrosse head having an optimized front scoop geometry as described above that extends over a significant portion of the scoop width, thereby protecting pocket stringing that extends through the scoop.

It is another object to provide a lacrosse head having an optimized front scoop geometry as above that is easily moldable and ultimately durable and robust.

The present invention is a lacrosse head having a distal scoop with a substantially constant cross-section along at least an inch, located one-half inch on either side of the front dead center of the scoop portion of the lacrosse head centered at its foremost center-point (e.g., A-A' of FIG. 1). The term "substantially constant cross-section" is herein defined as not deviating from the cross-section's basic shape and maintaining reasonable proportionality of the fundamental characteristics of that shape as described in the point framework defined below. Referring back to FIG. 5 (inset), the features of the present cross-section likewise resemble a knife blade, and the analogy is helpful in defining the relevant points. There is likewise a tip or "foremost point" (FP)", a spine (back edge of the blade), a tang embedded in the handle, the tang extending along a "rear edge" (RE) to a rearmost corner point (RCP). The blade edge runs from tip to a heel, and there is a recessed choil behind the heel arching inward. There is a "low continuous carve point" (LCP) where the heel joins the choil, the choil arching inward to a "rear-innermost point" (RI), all said points being connected by a continuous perimeter. The choil indentation at the heel in one preferred embodiment defines a U-shaped cavity and in another embodiment an angled notch, in either case the cavity or notch extending toward said foremost point (FP). In one embodiment, the perimeter section joining said foremost point (FP) and low continuous curve point (LCP) is a smooth continuous outwardly-convex curve. In another embodiment, the perimeter section joining said foremost point (FP) and low continuous curve point (LCP) is a relatively straight line. In yet another embodiment, when the lacrosse head is horizontally-oriented along the x-axis of an xyz coordinate system as shown in FIG. 10, the low continuous curve point (LCP) projects below the rearmost corner point (RCP), the rear innermost point (RI), and any point there between along the rear edge (RE). The improved scoop geometry is optimized to promote smooth ground ball play and to eliminate scoop string wear from playing surface contact.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The present invention is a molded double-wall synthetic lacrosse head having an improved scoop geometry that facilitates scooping up a ball while it rests or rolls on the playing surface.

For purposes of this disclosure, the lacrosse head "front dead center" is herein defined as the foremost point (FP) on the lacrosse head that is furthest along the x-axis from the origin when the lacrosse head is horizontally-oriented along the x-axis of an xyz coordinate system. FIGS. 6-9 illustrate the lacrosse head with improved scoop geometry for ground play according to the invention, which improved scoop geometry is described with reference to a cross-section taken at front dead center along the x-y plane.

Figure 6:
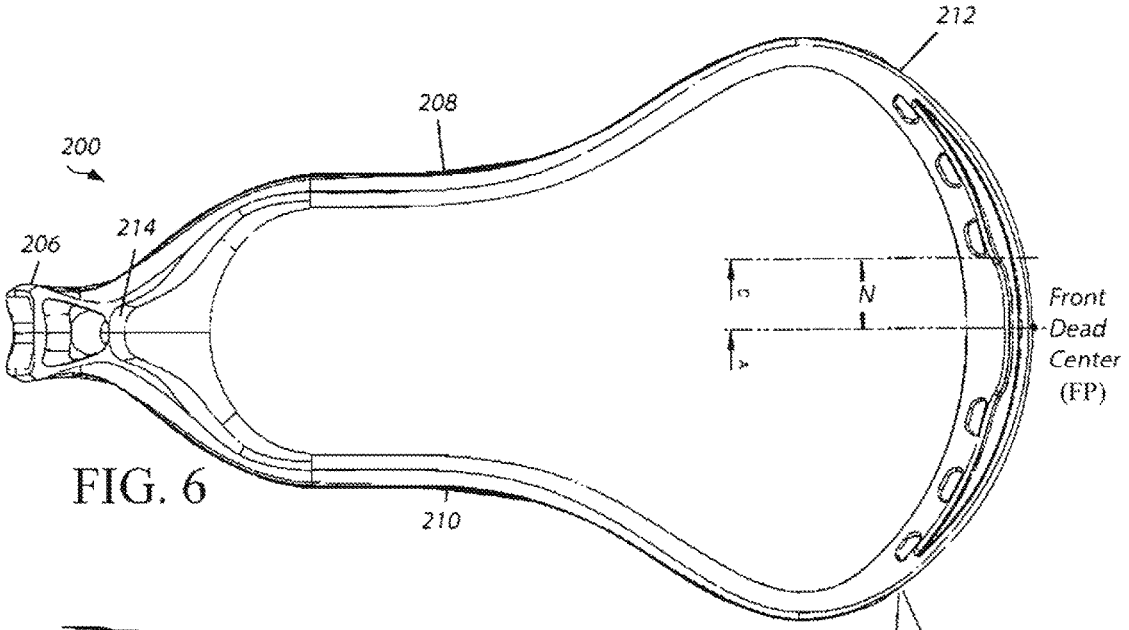
FIG. 6 is a top view of a lacrosse head 200 according to the present invention.

As seen in FIG. 6 the lacrosse head 200 generally comprises a V- or U-shaped frame engaged to a handle at a juncture 206. A stop member 214 is provided adjacent to the juncture 206 and a pair of sidewalls 208 and 210 extend from the stop member 214 and juncture 206 in a generally divergent arrangement ending at a curvilinear transverse wall 212 joining the sidewalls 208, 210 at their ends opposite juncture 206. The divergent sidewall arrangement provides a wider or enlarged transverse wall 212 that defines the scoop of the lacrosse head intended to catch or scoop up a ball and funnel it into a pocket toward the narrow end between the sidewalls 208, 210 and at the stop member 214. In order to facilitate scooping up a ball resting or rolling on the playing surface, the transverse wall 212 of the disclosure employs a substantially consistent geometry within a certain distance N extending on either side of the "foremost point" (FP).

As indicated above the cross-section resembles the blade of a chef's knife, analogously having a tip or "foremost point" (FP), a spine (back edge of the blade), an, opposing tang extending along a "rear edge" (RE) to a rearmost corner point (RCP), a point where the innermost heel joins the blade before the choil or, e.g., the "low continuous curve point" (LCP), and an indentation analogous to a choil at the juncture of the tang and heel, the indentation extending inward to a "rear-innermost point" (RI), all said points being connected by a continuous perimeter.

Figure 1:
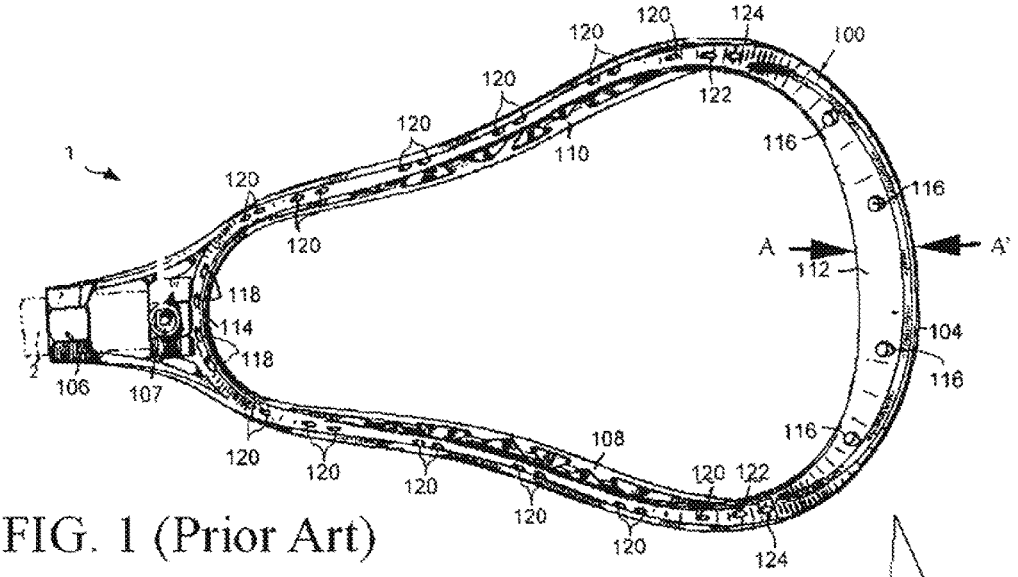
FIG. 1 (Prior Art)
FIG. 1 is a top view of a prior art lacrosse head.
Figure 2:
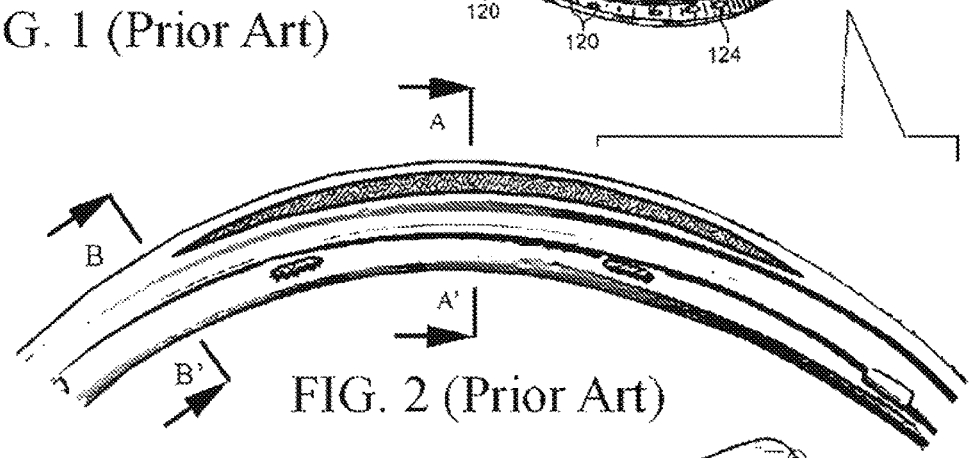
FIG. 2 (Prior Art)
FIG. 2 is an enlarged bottom view of the scoop of the prior art lacrosse head of FIG. 1.
Figure 3:
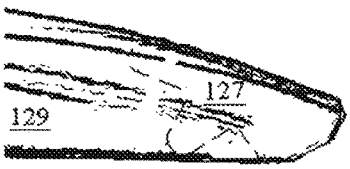
FIG. 3 (Prior Art)
FIG. 3 is a partial side view of the prior art lacrosse head a FIGS. 1-2.
Figure 4:
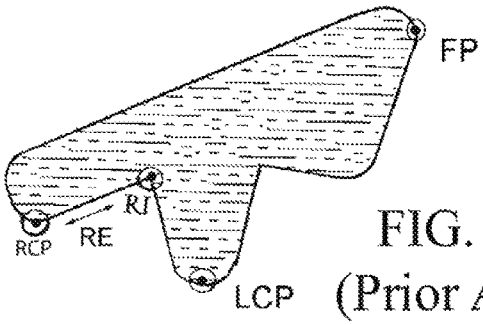
FIG. 4 (Prior Art)
FIG. 4 is a front dead-center cross-section of the scoop of the prior art lacrosse head of FIGS. 1-3 taken along line A-A' of FIG. 2.
Figure 5:
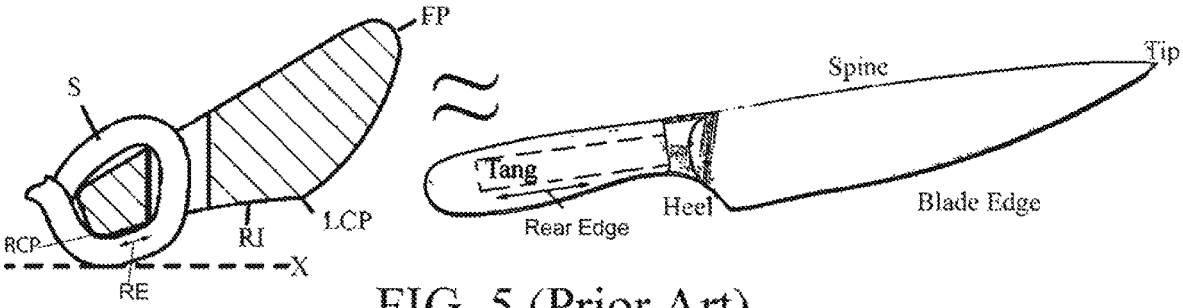
FIG. 5 (Prior Art)
FIG. 5 is a cross-section of the scoop of the prior art lacrosse head of FIGS. 1-3 taken along line B-B' of FIG. 2 with inset (right) illustrating knife shape.
Figure 10:
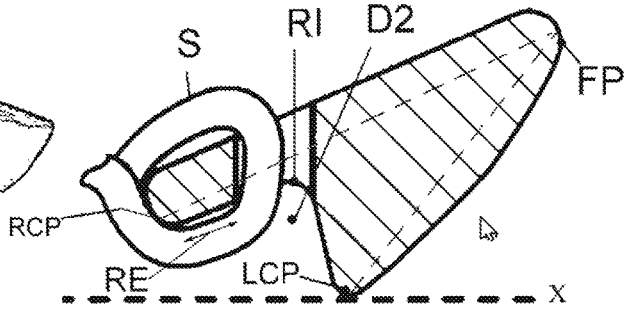
FIG. 10 is a diagram illustrating the essential characterizing features of the improved scoop of FIGS. 6-9.
Figure 11:
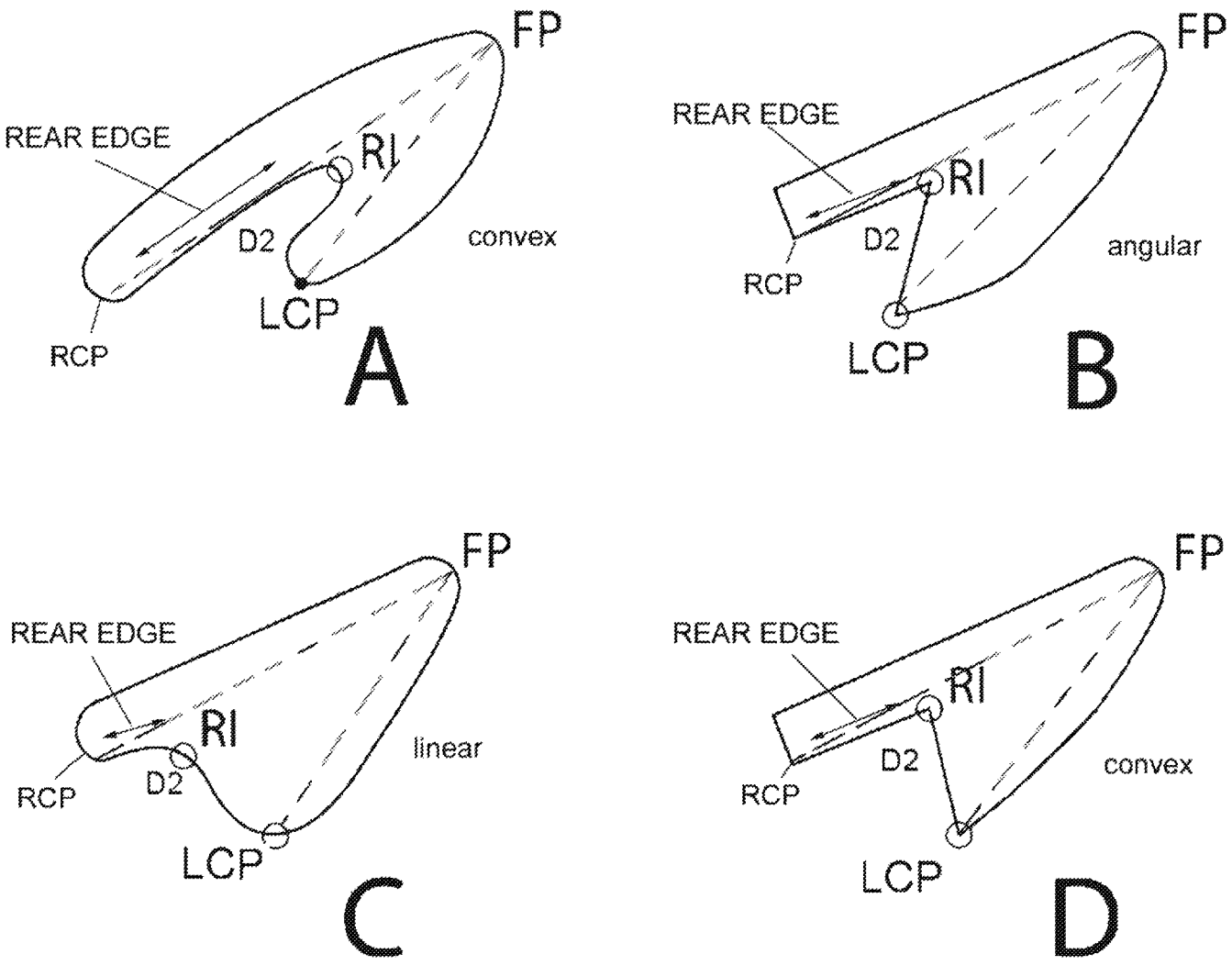
FIG. 11 illustrates variations on the improved scoop of FIGS. 6-10.

The present lacrosse head 200 geometry dictates that the "contact perimeter" joining FP and LCP is a smooth continuous straight line, slightly angular, or slightly-convex curve, which promotes smooth around ball play, such as scooping of a ball off of a playing surface. Toward this end the present invention flattens out the contact perimeter so that it is oriented along a low angle relative to the plane of the head 200, such that when the head 200 is lowered to the playing surface the contact perimeter is flat or nearly flat against the playing surface and offers little resistance to the ball entering the head and being funneled to the pocket. The perimeter between FP and LCP may be linear, angular or convex as described, but not jagged as per prior art FIG. 4. When the lacrosse head is horizontally-oriented along the x-axis of an xyz coordinate system, e.g., sitting flat on a table as seen in FIGS. 10-11, then the contact angle at any point between FP and LCP is acute, preferably within a range of from 5-85 degrees. Where the perimeter between FP and LCP is linear, after the lacrosse head is moved to a scoop position (rotated clockwise) the contact angle is constant at any point between FP and LCP. However, where the perimeter between FP and LCP is angular or convex the tangential contact angle is reduced toward the scoop position. That geometry enhances scooping, and the geometry remains substantially constant on either side of the FP point by distance N which is at least one-half inch on either side of the front dead center FP point of the scoop portion of the lacrosse head, more preferably greater than one-fifth of the total width of a lacrosse head, and optimally between 6-6½" (inside measurement) for a field player's head and between 10-12" (inside measurement) for a larger goal keeper head.

As depicted in FIG. 10 the cross-section is hounded by the FP, RE, RCP, and LCP, and the LCP is offset below an imaginary line extending from the RCP to the FP. The indentation at the juncture of the tang and heel is denoted as lower indentation D2 between the RCP and LCP and, in one embodiment, the rear-innermost point RI is the point of maximum concavity of this lower indentation D2. FIG. 10 shows the lacrosse head horizontally-oriented alone the x-axis of a xyz coordinate system, effectively lying flat on a table.

Figure 8A:
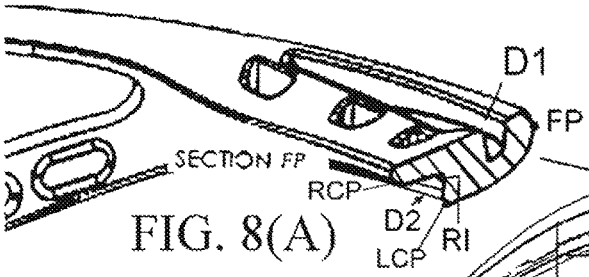
FIG. 8(A) is a perspective side view of the present invention with cross-section taken at point FP of FIG. 6.
Figure 8B:
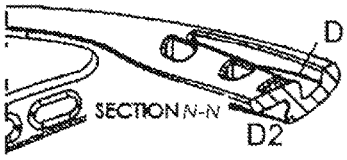
FIG. 8(B) is a perspective side view of the present invention with cross-section taken at distance N offset from point FP of FIG. 7.
Figure 7:
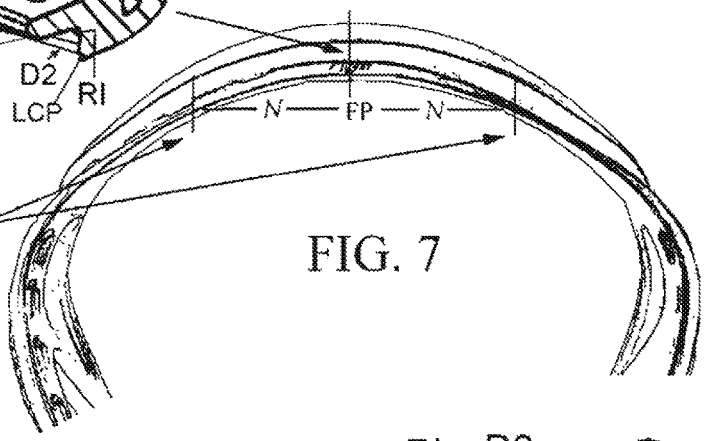
FIG. 7 is an enlarged bottom view of the scoop of the present invention.

FIG. 8(A) is a perspective view of the FP cross-section relative to the point on FIG. 7 where it was taken. The FP cross-section is generally characterized by this indentation D2 in combination with the perimeter between the LCP and FP points, which may define a smooth curve. The FP cross-section may also have an upper channel D1 that allows for the desired scoop flexibility while also maintaining the overall strength of the scoop element. The foregoing features produce a cross-section in the nature of a knife blade that promotes smooth ground ball play. One skilled in the art will understand that the characterizing FP cross-section remains substantially consistent for at least distance N on opposing sides of the FP point, where distance N is at least one-half inch on either side of the front dead center FP point of the scoop portion of the lacrosse head. Alternatively, the entirety of the scoop element may consist of the same Unproved cross-section. FIG. 8(B) illustrates that non-essential characterizing features such as the upper channel D1 may vary somewhat over distance N on opposing sides of the FP point, but the lower indentation D2 and perimeter geometry between LCP and FP is substantially constant in a given embodiment. The characterizing features are described in more detail below.

Figure 9:
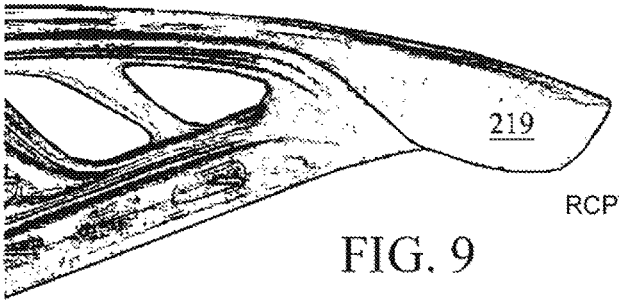
FIG. 9 is a side view of the improved scoop of FIGS. 6-8.

FIG. 8(A) illustrates the FP cross-section of FIG. 7, and FIG. 8(B) illustrates the cross-section at distance N from the FP point, and FIG. 9 is a side view. As seen in the side view of FIG. 9, the inventive scoop cross-section produces a ground contacting lip 219 that wraps around the central portion of the scoop and, in the process, provides cover for the pocket stringing exposed through scoop openings.

FIG. 10 is a diagram illustrating the essential characterizing features of the invention in a preferred embodiment, namely, the lower indentation D2 and arched perimeter between the foremost point (FP) and the low continuous curve point (LCP). The sides are joined in a closed-loop perimeter defined by the foremost point (FP), the rear edge (RE), rearmost corner point (RCP) and low continuous curve point (LCP), as designated in FIG. 10. In one preferred embodiment, there is a pronounced indentation D2 between the RE and LCP, and the rear-innermost point (RI) is the point of maximum indentation. The indentation D2 defines a U-shaped curve or V-shaped notch that extends a first distance d1 from RE to RI and a second distance d2 from RI to LCP, the first distance d1 being longer than the second distance d2. Alternatively, d1 and d2 can be the same distances or d2 may be longer than d1. In one embodiment, the perimeter section joining FP and LCP is a smooth continuous outwardly-convex curve configured to contact a playing surface. In another embodiment, the perimeter section joining FP and LCP is a relatively straight line. In the embodiment of and orientation shown in FIG. 10 (when the lacrosse head is horizontally-oriented along the x-axis of an xyz coordinate system) the LCP projects below FP, RE, RI, and any point there between. In any case the apex RI of indentation D2 is closer to the FP point than either LCP or the rear edge RE. The pronounced notch D2 in the direction of FP separates the rear edge RE and low continuous curve point LCP along the perimeter. The perimeter essentially takes the cross-sectional shape of a full-tang blade of a kitchen chefs knife with a choil corresponding to a U- or V-shaped cavity D2 between the tail extending inward and working in combination with the smooth underbelly to promote smooth ground ball play and scoop string protection. This feature greatly enhances a players' scooping skills fundamental to the game of lacrosse. Also, as clearly seen by the dotted line of FIG. 10, this optimized front scoop geometry displaces the low continuous curve point LCP away from RE, elevating pocket stringing S off the ground, thereby protecting pocket stringing S that extends through the scoop.

FIG. 11 illustrates several variations on the improved scoop cross-section of FIGS. 6-10, All the lacrosse heads of FIG. 11 are shown horizontally-oriented along the x-axis of an xyz coordinate system, e.g., sitting flat on a table. With all the lacrosse heads of FIG. 11; 1) there is a notch to RI; 2) the LCP is offset below an imaginary line extending from the RCP to FP; and 3) the perimeter section between the LCP point and FP point defines a relatively straight line or continuous smooth outwardly-convex curve. As seen in (A) and (B), RI may be closer to the FP than the LCP point, but as (C) illustrates, LCP may alternatively be forward of RI. As seen in (B) and (D), the notch D2 need not be U-shaped but may alternatively be angled with the perimeter lines creating the angle having about the same or slightly different lengths. Note also that with all the lacrosse heads of FIG. 10 and 11 that given an imaginary line drawn from the RCP to the FP, another imaginary line drawn from FP to LCP diverges below that line at an acute angle within a range of from 5-85 degrees.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. A lacrosse head configured as a monolithic frame for supporting a pocket, including a stop member, a pair of sidewalls extending from the stop member, and a curvilinear scoop joining the sidewalls, said scoop arching to a foremost center point furthest from said stop member, and said scoop having a cross-section at said foremost center point, said cross-section defined by an outer perimeter defining a tip at said foremost center point, said cross-section perimeter extending on one side of said foremost center point to a rearmost corner point and on the other side to a low continuous curve point, the perimeter joining said low continuous curve point and rearmost corner point along an inwardly-recessed perimeter cavity, the low continuous curve point being offset below the foremost center point, the rearmost corner point, the rear innermost point, or any point there between when the lacrosse head is oriented flat on a horizontal surface, and the perimeter between said foremost enter point and low continuous curve point being one of linear, angular or convex.

2. The lacrosse head according to claim 1, wherein the perimeter cavity between the rearmost point and low continuous curve point is substantially U-shaped.

3. The lacrosse head according to claim 1, wherein the perimeter cavity between the rearmost point and low continuous curve point is substantially V-shaped.

4. The lacrosse head according to claim 3, wherein the perimeter cavity extends toward said foremost point.

5. The lacrosse head according to claim 1, wherein the cross-sectional shape of said scoop at said foremost center point remains substantially constant for a half inch on either side of said foremost center point.

6. The lacrosse head according to claim 1, wherein the cross-sectional shape of said scoop remains substantially constant over at least one inch of said scoop.

7. The lacrosse head according to claim 1, wherein the perimeter between said foremost point and low continuous curve point is substantially linear.

8. The lacrosse head according to claim 6, wherein the linear perimeter between said foremost point and low continuous curve point diverges below a line extending from the rearmost corner point and foremost point at an angle within a range of from 5-85 degrees.

9. The lacrosse head according to claim 1, wherein the perimeter between said foremost point and low continuous curve point is convex.

10. A lacrosse head having a distal scoop with a cross-section extending along at least the middle portion of said scoop, said cross-section being defined by a continuous closed-loop perimeter defining a tip at said foremost center point, the cross-section perimeter extending on one side from said foremost center point to a rearmost corner point and on the other side to a low continuous curve point the cross-section perimeter joining said low continuous curve point and rearmost corner point along an inwardly-recessed perimeter cavity, the low continuous curve point being offset below the foremost point, the rearmost corner point, the rear innermost point, or any point there between when the lacrosse head is oriented flat on a horizontal surface, and wherein the perimeter of said scoop between said foremost point and low continuous curve point defines a smooth continuous outwardly-convex curve.

11. The lacrosse head according to claim 10, wherein the perimeter cavity is U-shaped.

12. The lacrosse head according to claim 10, wherein the perimeter cavity is V-shaped.

13. The lacrosse head according to claim 10, wherein the cross-sectional shape of said scoop at said foremost center point remains constant at least one-half inch on either side of said foremost point.

14. The lacrosse head according to claim 10, wherein the perimeter cavity between the rearmost corner point and low continuous curve point is substantially U-shaped.

15. The lacrosse head according to claim 10, wherein the perimeter cavity between the rearmost corner point and low continuous curve point is substantially V-shaped.

16. The lacrosse head according to claim 10, wherein the cross-sectional shape of said scoop t remains substantially constant over at least one inch of said scoop.

17. A lacrosse head having a distal scoop with a constant cross-section extending along at least the middle portion of said scoop, said cross-section defined by a continuous closed-loop perimeter having a spine, a foremost point, a rear edge, a rearmost corner point, a low continuous curve point, and a rear-innermost point, the low continuous curve point being offset below the foremost point, the rearmost corner point, the rear innermost point, or any point there between when the lacrosse head is oriented flat on a horizontal surface, and said continuous cross-section perimeter between said rearmost corner point and low continuous curve point defining a cavity extending toward said foremost point, and wherein the perimeter of said scoop runs substantially linearly between said foremost point and low continuous curve point.

18. The lacrosse head according to claim 17, wherein the perimeter cavity is U-shaped.

19. The lacrosse head according to claim 17, wherein the perimeter cavity is V-shaped.

20. The lacrosse head according to claim 17, wherein the cross-sectional shape of said scoop at said foremost center point remains constant at least one half inch on either side of said foremost point.

21. The lacrosse head according to claim 17, wherein the linear perimeter between said foremost point and low continuous curve point diverges below a line extending from the rearmost corner point to said foremost point at an angle within a range of from 5-85 degrees.

22. A lacrosse head, comprising:

a closed-loop generally V-shaped frame aligned along a geometric plane, and having two side walls joined at a stop member and diverging therefrom and a transverse scoop joining the ends of said side walls opposite of said stop member, said scoop comprising string holes through which pocket string is attached and a substantially constant cross-section extending proximate the middle of said scoop's transverse length, said constant cross-section having a continuous perimeter defined by a foremost point farthest from said stop member, a rear edge farthest from said foremost point, a rear innermost point, a rearmost corner point along said rearmost edge, a low continuous curve point, and;

wherein said cross-section perimeter begins at the lowest continuous curve point and continues a first distance to said rear innermost point and a second distance toward said rearmost corner point;

said first distance being longer than said second distance;

the cross-section perimeter between the low continuous curve point and said rearmost corner point defines an inwardly-recessed perimeter cavity; and wherein said cross-section perimeter between said low continuous curve point and said foremost point at said middle cross-section defines a continuous smooth curve.

23. A lacrosse head having a distal scoop with a substantially constant cross-section along at least the middle portion of said scoop, said constant cross-section being defined by a continuous closed-loop perimeter having a foremost point, a rear edge, a rearmost corner point, a low continuous curve point, and a rear-innermost point, the low continuous curve point being offset below the foremost point, the rearmost corner point, the rear innermost point, or any point there between when the lacrosse head is oriented flat on a horizontal surface, and said perimeter between said rearmost corner point and low continuous curve point defining a concave cavity at said rear innermost point in the direction of said foremost point, wherein the underbelly of said cross-section between said foremost point and low continuous curve point defines a smooth continuous outwardly-convex curve.

24. The lacrosse head according to claim 23, wherein said concave cavity is acutely angled.

* * * * *